United States Patent [19]

Fernandez et al.

[11] 4,353,689

[45] Oct. 12, 1982

[54] HEATING ARRANGEMENT FOR REVOLVING BODIES WHOSE DIAMETER VARIES DURING PRODUCTION THEREOF BY BUILD-UP WELDING

[75] Inventors: José Fernandez; Jürgen Herm; Heinz Krakow; Ernst Wortmann; Harald Tomsen, all of Hamburg, Fed. Rep. of Germany

[73] Assignee: Thyssen Aktiengesellschaft vorm. August Thyssen-Hütte, Duessoldorf, Fed. Rep. of Germany

[21] Appl. No.: 199,477

[22] Filed: Oct. 22, 1980

[30] Foreign Application Priority Data

Oct. 24, 1979 [DE] Fed. Rep. of Germany ..... 2942867

[51] Int. Cl.[3] ..... F24J 3/00

[52] U.S. Cl. ..... 432/225; 432/230; 432/231

[58] Field of Search ..... 432/225, 229, 230, 231; 266/57, 61

[56] References Cited

U.S. PATENT DOCUMENTS

| | | | |
|---|---|---|---|
| 1,082,515 | 12/1913 | Gogel | 432/225 |
| 2,541,344 | 2/1951 | Davis | 266/67 |
| 2,589,495 | 3/1952 | Hess et al. | 432/225 |
| 3,089,686 | 5/1963 | Jenkins et al. | 432/230 |
| 3,463,474 | 8/1969 | Muller et al. | 266/57 |

FOREIGN PATENT DOCUMENTS

| | | | |
|---|---|---|---|
| 261428 | 1/1970 | U.S.S.R. | 432/225 |

*Primary Examiner*—John J. Camby

*Attorney, Agent, or Firm*—Toren, McGeady & Stanger

[57] ABSTRACT

A heating arrangement is provided for apparatus for producing cylindrical bodies by build-up welding wherein the diameter of the body being produced varies during the build-up welding operation. The heating arrangement is composed of individual heating elements arranged in the region of a sector around the revolving body with the heating elements being controlled both individually and in groups.

2 Claims, 2 Drawing Figures

HEATING ARRANGEMENT FOR REVOLVING BODIES WHOSE DIAMETER VARIES DURING PRODUCTION THEREOF BY BUILD-UP WELDING

This invention relates generally to apparatus for producing cylindrical bodies by build-up welding and, more particularly, to a heating arrangement for such apparatus which will accommodate the varying diameter of the body being produced during the build-up welding operation.

Revolving bodies which are produced by the build-up welding technique must be heated and they must be maintained at a certain temperature for the duration of the build-up welding operation for maintaining proper welding material temperature. Thus, it is necessary that, on the one hand, optimum welding conditions are maintained and that, on the other hand, stresses are avoided which may be caused by temperature gradients between the welding point and remote areas of the workpiece. Depending upon the strength and toughness of the welding material, these stresses may even cause cracks in the workpiece.

In order to avoid these stresses, it is necessary that the revolving body be heated in such a way that temperature differences taken over the entire length of the revolving body between the surface and the core will not be greater than about 30° C. Since the heat radiation of the revolving workpiece is of a different magnitude, especially in the end zones due to the longitudinal end faces of the workpiece, different quantities of heat must be supplied to the revolving workpiece at various points thereon.

Accordingly, the present invention is directed toward the provision of apparatus which will meet the requirement of supplying different quantities of heat to a build-up welding workpiece and which will, moreover, make it possible for the supply of heat energy to be adapted to the increasing heat radiation emitted from the surface of the workpiece which increases with the diameter of the revolving workpiece.

SUMMARY OF THE INVENTION

Briefly, the present invention may be described as a heating arrangement for apparatus wherein a revolving workpiece is formed by applying built up weld material thereon, the heating arrangement being composed of individual heating elements placed around the revolving workpiece in the region of a sector thereof with the heating elements being controlled individually and/or in groups.

The approach utilized with the present invention makes it possible to adapt the heating capacity of the heating arrangement to the quantity of heat energy required at each point on the workpiece, not only over the entire length of the workpiece, but also on the sector arc.

In order to facilitate an even finer adaptation of the heating capacity to the respective requirements, the invention provides that the heating capacity of each individual heating element is advantageously individually controllable.

When the diameter of the revolving workpiece is still relatively small, it is possible that the welding heat which is introduced will be greater than the heat quantity emitted from the surroundings by radiation from the workpiece. For this case, it is necessary that the heating arrangement be switched off entirely. Indeed, under special conditions it may even be necessary to additionally cool the revolving workpiece over its entire length.

When the diameter of the revolving workpiece increases, the ratio between the supplied welding heat and the quantity of heat emitted will be reversed so that the heating arrangement must be appropriately switched for operation.

In order to take into account the fact that the diameter of the workpiece increases, in accordance with a further development of the invention, it is provided that the heating elements are constructed so as to be movable at a right angle relative to the axis of the revolving workpiece. As a result, the apparatus ensures that it will always be possible to maintain a defined distance between the revolving workpiece and the heating arrangement.

Since the emitting area of the heating arrangement must be designed for the maximum required radiation capacity, the outer heating elements of the sector are arranged so as to be movable relative to the inner heating elements transversely of the axis of the body of revolution in order to ensure that the heating arrangement may be moved as closely as may be required to the basic body of the workpiece which will still have a small diameter without causing collision with other necessary functional groups, such as dollies and equipment in the cooling zone behind the welding head.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
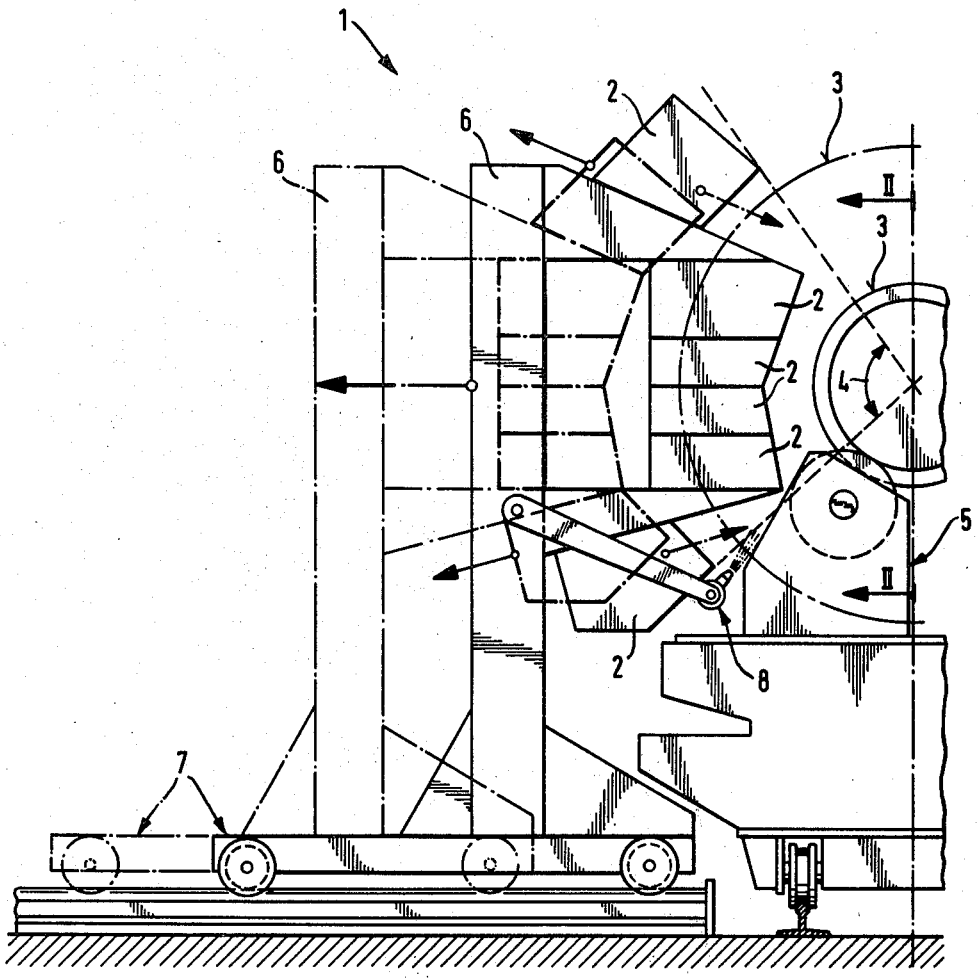
FIG. 1 is a schematic side view of a heating arrangement in accordance with the invention.

Referring now to the drawings, wherein like components are designated by like reference numerals in both figures thereof, a heating arrangement generally designated with the reference numeral 1 is depicted which is composed of individual heating elements 2 arranged, on the one hand, in a sector 4 one above the other around a revolving workpiece 3 which is to be heated, with the heating elements 2 being, on the other hand, located one next to the other in the direction of the generating line of the revolving workpiece 3.

Figure 2:
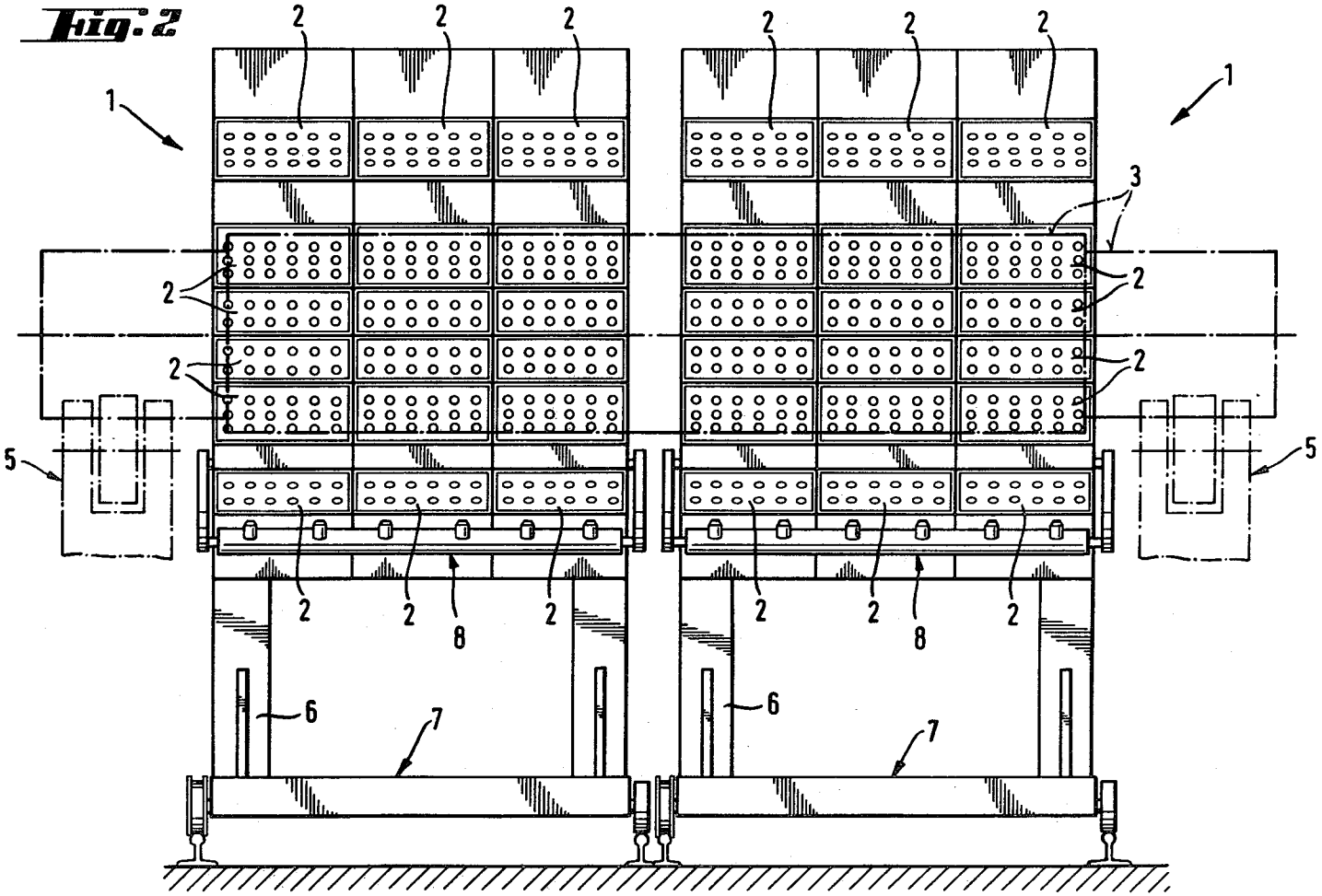
FIG. 2 is a front view of the heating arrangement in accordance with the invention.

As indicated in FIG. 2, the revolving workpiece 3 is supported upon dollies 5 and is rotated about its axis by a positive locking engagement or in a frictional manner (not shown) from an end face thereof by appropriate drive arrangement (not shown).

The heating arrangement 1 is mounted on an undercarriage 7 by means of a frame 6. The heating arrangement 1 can be moved transversely of the axis of the revolving workpiece 3 on the undercarriage 7. Independently therefrom, the outer heating elements 2 can be moved relative to the inner heating elements of the sector 4 in the same direction. A cooling system denoted by reference numeral 8 is arranged alongside the generating line of the revolving workpiece 3. This cooling system is used in a case where there is heat excess in the revolving workpiece 3.

FIG. 1 illustrates, on the one hand, the position of the heating arrangement 1 and the heating elements 2 relative to a revolving workpiece 3 which still has a relatively small diameter. Also shown in broken lines is the position in a case where the revolving workpiece 3 has its diameter increased by the build up welding process.

In order to enable the heating arrangement 1 to be moved as closely as possible to the revolving workpiece 3, so that greater economy of operation may be achieved, particularly when the workpiece has a small diameter, the outer heating elements 2 of the sector 4 which would otherwide collide with other functional groups of the apparatus, such as the welding device and the dollies, are moved back into their rearward positions. This is possible because only a low heating capacity is required when the workpiece 3 still has a relatively small diameter and, thus, only an appropriately smaller number of heating elements 2 need be switched on.

When the diameter of the workpiece 3 increases, the heating arrangement 1 is moved back with the undercarriage 7 and the outer heating elements 2 are moved into the forward position to the extent that they will be free of other functional groups. Travel of the heating arrangement 1 over the undercarriage 7 and of the outer heating elements 2 is automatically controlled through sensors. Moreover, it is possible to control the heat capacity of the heating arrangement 1 in such a way that it corresponds to the heat requirement of the revolving workpiece 3 at any location. For this purpose, as previously mentioned, the heating arrangement 1 is composed of heating elements 2 which may be controlled individually or in groups and whose individual capacity can also be controlled.

While a specific embodiment of the invention has been shown and described in detail to illustrate the application of the inventive principles, it will be understood that the invention may be embodied otherwise without departing from such principles.

What is claimed is:

1. Heating apparatus for a revolving workpiece of increasing diameter having a generally cylindrical configuration defining a generally horizontal axis of revolution wherein said workpiece is produced by build up of welding material thereon during a welding process comprising: an assemblage of heating elements located alongside said workpiece and confined to within a geometrical sector bounded by a pair of radii extending through said horizontal axis of revolution perpendicularly thereto; said heating elements being generally arranged to extend in the vicinity of a circular arc of said geometrical sector; said heating elements including a first plurality of heating elements arranged generally centrally of said sector on said circular arc and a second plurality of heating elements divided into two groups each located circumferentially on opposite sides of said first plurality of heating elements; said first and said second plurality of heating elements being movable relative to each other in directions extending radially generally perpendicularly to said horizontal axis of revolution whereby said first plurality of heating elements may be moved closer to said workpiece than said second plurality of heating elements during the initial stages of said build up of welding material when said diameter of said workpiece is relatively smaller; and undercarriage means upon which said first and second plurality of heating elements are mounted for moving said heating elements together relative to said workpiece perpendicularly to said axis of revolution toward and away from said workpiece; said first and second plurality of heating elements being thereby movable relative to each other toward and away from said workpiece to enable control of the heat energy imparted to said workpiece in dependence upon the degree of the increase in the diameter thereof.

2. Apparatus according to claim 1 wherein the heating capacity of each of said individual first and second plurality of heating elements may be controlled individually.

* * * * *